United States Patent [19]

Shrader et al.

[11] Patent Number: 4,865,390

[45] Date of Patent: Sep. 12, 1989

[54] CONTINUOUS MINING MACHINE WITH ROOF SUPPORTING APPARATUS AND METHOD FOR ANCHORING CROSSBEAM SUPPORTS

[75] Inventors: Samuel E. Shrader, McMurray; Peter F. Singleton, Pittsburgh; William G. Young, Greensburg; Robert Kaminsky, Library, all of Pa.

[73] Assignee: Consolidation Coal Company, Pittsburgh, Pa.

[21] Appl. No.: 93,012

[22] Filed: Sep. 4, 1987

[51] Int. Cl.[4] ..... E21C 35/20; E21D 20/00

[52] U.S. Cl. ..... 299/11; 198/522; 299/33

[58] Field of Search ..... 299/11, 31, 33, 64, 299/67; 198/522; 405/299, 300, 290, 291; 173/31, 32, 35, 36

[56] References Cited

U.S. PATENT DOCUMENTS

| | | | |
|---|---|---|---|
| 3,493,058 | 2/1970 | Zitco | 299/33 |
| 3,680,920 | 8/1972 | Amoroso | 198/522 X |
| 3,951,215 | 4/1976 | Galis | 173/23 |
| 4,226,476 | 10/1980 | Fairchild et al. | 299/33 X |
| 4,284,368 | 8/1981 | Albright | 405/291 |
| 4,740,037 | 4/1988 | Eager et al. | 299/33 X |
| 4,753,486 | 6/1988 | LeBegue | 299/33 X |

FOREIGN PATENT DOCUMENTS

| | | | |
|---|---|---|---|
| 505799 | 4/1976 | U.S.S.R. | 299/33 |

*Primary Examiner*—Jerome W. Massie, IV

*Assistant Examiner*—David J. Bagnell

*Attorney, Agent, or Firm*—Stanley J. Price, Jr.

[57] ABSTRACT

A continuous mining machine is provided which includes a frame assembly having a material dislodging head mounted on one end of the frame. Ground engaging traction treads or wheels propel the machine within a mine to advance the dislodging head into a mine face to dislodge material therefrom. The mining machine also includes roof support apparatus capable of assuming a free-standing position separated from the mining machine to install supports in the roof above the mining machine as the mining machine continuously advances. The roof support apparatus includes a transverse beam having a pair of end portions extending outwardly from the sides of the frame assembly. Connected to the ends of the transverse beam are a pair of support assemblies each including apparatus for lifting the roof support apparatus vertically off the mining machine and initially supporting the mine roof. Each support assembly further includes apparatus for lifting a crossbeam into abutting contact with the mine roof and apparatus operable to drill a hole through the crossbeam into the mine roof and thereafter anchor the crossbeam to the mine roof with roof bolts. The minimg machine also includes a pair of gathering head extensions positioned laterally on the gathering head rearwardly of the dislodging head. Each gathering head extension is movable in a linear path from a retracted position to an extended position to engage an adjacent mine rib and deflect loose material from the mine floor onto the gathering head.

19 Claims, 5 Drawing Sheets

CONTINUOUS MINING MACHINE WITH ROOF SUPPORTING APPARATUS AND METHOD FOR ANCHORING CROSSBEAM SUPPORTS

BACKGROUND OF THE INVENTION

1. Field of the Invention

This invention relates to a mining machine, and more particularly, to a continuous mining machine having roof support apparatus operable to permanently support a mine roof at predetermined locations above the mining machine while the mining machine is continuously advanced into a face of the mine to dislodge material therefrom. The mining machine furhter includes gathering head extensions positioned laterally on the front end of the mining machine gathering head operable to deflect dislodged material from a floor of the mine onto the mining machine.

2. Description of the Prior Art

It is well known in underground mining operations to provide a mining machine which is designed to continuously advance along a floor of the mine and dislodge material from a mine face. The dislodged material is conveyed rearwardly of the mining machine for further treatment. However, it is not uncommon for the mining operation to be stopped at various times and the mining machine withdrawn from the mine face in order to install supports in the mine roof above the mining machine.

Various types of roof bolters have been utilized for movement into the entry adjacent the mine face for installation of roof bolts in the mine roof to support the roof adjacent the face. U.S. Pat. No. 2,771,273 discloses a portable roof drilling and bolting machine operable to install roof bolts in a mine roof. U.S. Pat. Nos. 4,094,158 and 4,097,854 each disclose mine roof bolting apparatus which includes a temporary roof support to insure the stability of the roof during installation of roof bolts.

U.S. Pat. No. 3,268,258 discloses a surge device that is positioned behind a continuous miner having roof bolters mounted on the sides thereof. The surge device is moved under the tail conveyor of the mining machine a sufficient distance to allow the mining machine to continue to advance while the surge device remains stationary and the roof bolters set bolts in the roof. The surge device is then advanced to its original position under the tail conveyor of the mining machine.

U.S. Pat. No. 3,493,058 discloses a roof drilling and bolting apparatus which is mounted on the side of a continuous mining machine. The apparatus includes a carriage with a bolter mast, a roof jack and a floor jack mounted thereon. The roof jack and floor jack are arranged to provide temporary support between the roof and floor of the mine and to lock the bolter carriage in a fixed position during installation of the roof bolts. The bolter apparatus remains stationary during installation of the roof bolts as the mining machine continues to dislodge material from the mine face.

U.S. Pat. No. 3,813,126 discloses a continuously operable underground mining vehicle that includes temporary roof supporting apparatus, and rock cutting apparatus mounted on an end of a mobile frame. Hydraulic jacks are mounted on the mobile frame to provide temporary roof support above the vehicle. A pair of roof bolters are disposed between the jacks to provide permanent support for the area over the vehicle. A water jet nozzle is movably mounted in front of the vehicle to dislodge material from the mine face as the roof bolts are installed.

U.S. Pat. No. 4,131,317 discloses a mining machine having roof support apparatus for continuously supporting the mine roof as material is dislodged from the mine face and provided to a conveying apparatus which removes the dislodged material rearwardly from the face. Roof drilling units associated with each of the roof supporting units permit simultaneous drilling of bore holes in the roof and installation of roof bolts while the mining machine is dislodging material from the face.

U.S. Pat. No. 4,199,193 discloses a mining machine having a main frame with a front portion and a rearwardly extending portion, and cutter heads disposed for movement across the front portion for dislodging material from a mine face. A conveyor system extends across the front of the main frame and along the rearwardly extending portion for carrying dislodged material from the mine face. Forward roof support jacks are attached to the main frame to provide temporary roof support. Rear roof support jacks positioned on either side of the rearwardly extending frame portion are connected to the front portion of the frame by cylinders and also provide temporary roof support. Roof bolters are attached to the rear roof support jacks for installing roof bolts as the machine advances.

U.S. Pat. No. 4,310,197 discloses a mining apparatus and a bolting apparatus positioned in a mine entry adjacent a mine face under a temporary roof support. The temporary roof support is comprised of cross beams supported by beam jacks. The mining apparatus removes material from the mine face to advance the mine face. The bolting apparatus installs roof bolts to provide a permanent roof support. The bolting apparatus includes lowering means for lowering the temporary roof supports after the roof bolts are installed.

A continuous mining machine having roof bolting apparatus is illustrated in an article appearing in COAL AGE magazine, November, 1986, on page 17, entitled "Fairchild Seeks New Financing For Its Umbrella Miner." The illustrated mining machine consists of a main frame having a front portion and a rearwardly extending portion. Cutter heads are positioned on the main frame front portion for dislodging material from a mine face. Roof bolter assemblies are positioned on each side of the rearwardly extending portion for providing roof support as the mining machine advances into the mine face. A conveyor assembly is pivotally connected rearwardly of the mining machine for receiving material dislodged from the mine face.

Although the prior art devices suggest apparatus for installing roof bolts in a mine roof as a mining machine is advanced into the face of the mine, there is a need for an improved mining machine capable of providing temporary roof support above the mining machine while installing permanent roof supports in the mine roof as the mining machine continuously advances to dislodge material from the mine face. The apparatus must be capable of standing independently of the mining machine as the mining machine advances into the mine face. Longitudinal, vertical and lateral freedom between the mining machine and the free-standing roof support apparatus permits simultaneous installation of roof supports and removal of material from the mine face.

It is also known to provide mining machines with material gathering apparatus for collecting loose material from the mine floor adjacent the mine ribs and directing the collected material onto the mining machine.

U.S. Pat. No. 4,199,193 discloses a continuous mining machine which includes a T-shaped main frame having a front portion and a rearwardly extending portion. Rib cleaners are pivotally connected to the sides of the main frame front portion and are urged outwardly by hydraulic cylinders to contact the adjacent mine ribs and channel loose material onto a conveyor mounted on the main frame.

U.S. Pat. No. 4,296,856 discloses a mining machine which includes a mobile body having an endless conveyor for conveying rearwardly on the body material dislodged by the mining machine. A gathering platform extends forwardly from the conveyor. Oscillating gathering arms positioned laterally of the receiving end of the conveyor on the gathering platform feed dislodged material onto the receiving end of the conveyor. Deflector plates are pivotally mounted on the gathering platform to deflect loose material deposited on the mine floor along the mine wall onto the gathering platform. The deflector plates are biased laterally outwardly from the gathering platform by a spring to maintain the deflector plates in contact with the mine wall.

While the prior art mining machines suggest apparatus for collecting loose material from a mine floor, there is a need for an improved gathering device for a continuous mining machine in which the side edge portions of the gathering device are maintained in a position relative to the mine wall to direct loose material on the mine floor at the mine wall onto the gathering platform as the mining machine advances through the mine. The gathering device must be capable of linear movement on the gathering platform to prevent the gathering device from being damaged by protrusions on the mine wall.

SUMMARY OF THE INVENTION

In accordance with the present invention, there is provided a mining machine including a frame assembly having a front end portion and a rear end portion. A dislodging means is mounted to the frame assembly front end portion, and propelling means connected with the frame assembly propels the mining machine within a mine along a floor of the mine to advance the dislodging means into a face of the mine to dislodge material therefrom. A longitudinal conveyor is mounted on the frame assembly and extends rearwardly from the mobile frame assembly front end portion to receive dislodged material from the dislodging means and transport the dislodged material rearwardly of the mining machine. A longitudinal support means is positioned on each side of the longitudinal conveyor means to support a transverse beam. The transverse beam is movably positioned on the pair of longitudinal support means and has a pair of end portions which extend outwardly from the sides of the frame assembly. A pair of individual support assemblies are secured to the end portions of the transverse beam. Each support assembly includes roof bolting means for installing roof bolts at predetermined locations in a roof of the mine and roof support means operable to engage the roof and floor of the mine to provide temporary roof support as the roof bolting means is operated.

Further in accordance with the present invention, there is provided a method for anchoring crossbeam supports to a mine roof while dislodging material from a mine face comprising the steps of providing a frame assembly having dislodging means mounted on one end thereof, and positioning a transverse beam on a longitudinal support means which extends upwardly from the frame assembly so that the end portions of the transverse beam extend outwardly from the sides of the frame assembly. The method includes the further steps of securing a pair of support assemblies to the end portions of the transverse beam. Each assembly includes crossbeam lift means, roof bolting means and temporary roof support means. A crossbeam is positioned on the pair of crossbeam lift means so that portions of the crossbeam lie directly above the pair of roof bolting means. Thereafter, the temporary roof support means is extended into contact with the roof and floor of the mine to provide temporary roof support, and the crossbeam is lifted into abutting contact with the mine roof by the crossbeam lift means. Drill means is inserted into the pair of roof bolting means and the roof bolting means are raised to drill a pair of holes through the crossbeam and into the mine roof. The pair of roof bolting means are thereafter lowered and roof bolts are inserted into the pair of roof bolting means. The roof bolting means are raised so that the roof bolts pass through the holes drilled in the crossbeam and into the holes in the mine roof to anchor the crossbeam to the mine roof. The mining machine is propelled along the mine floor to advance the dislodging means into the face of the mine to dislodge material therefrom as the crossbeam is being secured to the mine roof.

Additionally in accordance with the present invention, there is provided a continuous mining machine for dislodging material from a mine face which includes a frame assembly having a front end portion and a rear end portion. A dislodging means is mounted on the frame assembly front end portion, and propelling means is provided for propelling the frame assembly along the floor of the mine to advance the dislodging means into a mine face to dislodge material therefrom. A longitudinal conveyor means is mounted on the frame assembly and extends rearwardly from the frame assembly front end portion to receive and transport material dislodged by the dislodging means to a location rearwardly of the mining machine. The mining machine includes a pair of gathering head extensions each positioned laterally on the mining machine gathering head and rearwardly of the dislodging means. Each gathering head extension is movable in a linear path from a retracted position to an extended position to engage an adjacent mine rib and deflect dislodged material from the mine floor onto the gathering head.

Accordingly, the principal object of the present invention is to provide a mining machine which includes apparatus for installing roof supports above the mining machine while the mining machine is being propelled within a mine to dislodge material from a face of the mine.

It is a further object of the present invention to provide a mining machine which includes a roof support assembly movably positioned on the mining machine frame assembly which is operable in a free standing position to provide permanent roof support above the mining machine while the mining machine is being propelled within a mine to dislodge material from the face of the mine.

It is still another object of the present invention to provide a method of continuous mining including the steps of propelling a mining machine within a mine to advance a dislodging head into a face of the mine and remove material therefrom and installing permanent roof supports in a roof of the mine above the mining machine during the advancement of the dislodging means into the mine face.

It is yet another object of the present invention to provide a mining machine which includes a pair of gathering head extensions positioned laterally on the mining machine gathering head rearwardly of a dislodging means operable in an extended position to engage adjacent mine ribs and deflect dislodged material from a floor of the mine onto the gathering head.

These and other objects of the present invention will be more completely disclosed and described in the following specification, the accompanying drawings and the appended claims.

DESCRIPTION OF THE PREFERRED EMBODIMENTS

Figure 1:
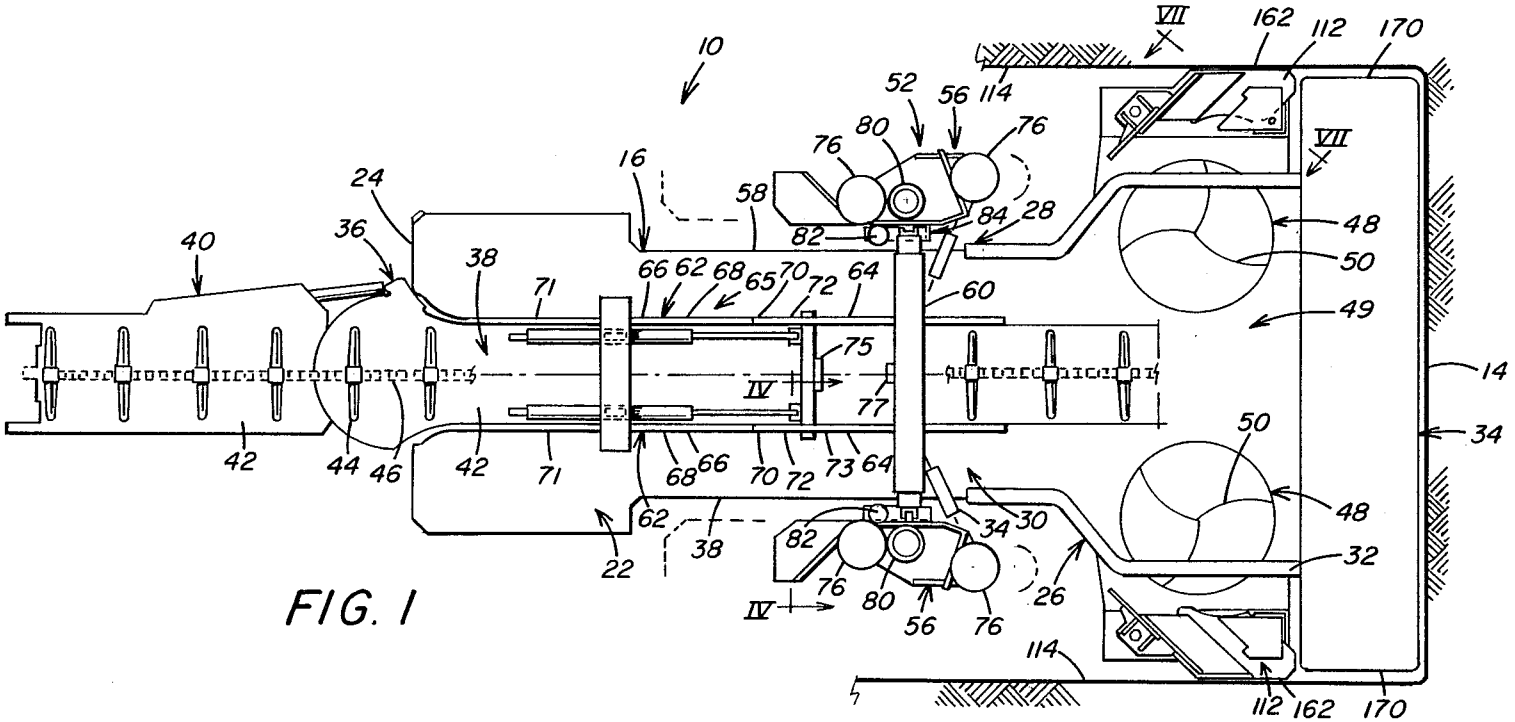
FIG. 1 is a top plan view of a continuous mining machine, illustrating a roof support assembly positioned for movement on the mining machine and a pair of gathering head extensions for deflecting loose material from a mine floor onto the mining machine.
Figure 2:
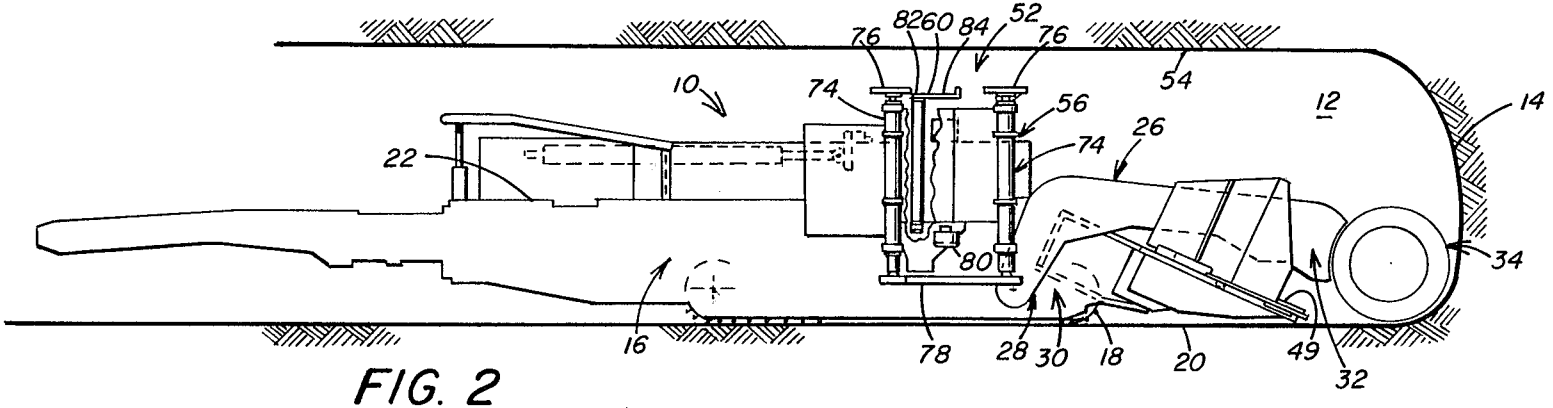
FIG. 2 is a partial fragmentary, side elevational view of the continuous mining machine illustrated in FIG. 1.

Referring to the drawings, and particularly to FIGS. 1 and 2, there is illustrated a continuous mining machine generally designated by the numeral 10 for use in an underground mine 12 to dislodge material from a mine face 14. Continuous mining machine 10 includes a frame assembly 16 and a pair of ground engaging traction means 18 (one shown) positioned at each side of frame assembly 16 for propelling continuous mining machine 10 within mine 12 along the floor 20 thereof.

Continuous mining machine 10 is capable of being operated from an operating station 22 in a manner similar to other such machines to dislodge material from mine face 14 and transport the dislodged material rearwardly of the rear end 24 of mining machine 10. Accordingly, mining machine 10 includes operating controls and sources of power for operating ground engaging traction means 18 and other equipment included thereon.

Mining machine 10 includes a boom assembly schematically illustrated and designated by the numeral 26 which has a rear end portion 28 pivotally secured to the front end 30 of frame assembly 16. Boom assembly 26 also includes a front end portion 32. As seen in FIGS. 1 and 2, a material dislodging head generally designated by the numeral 34 is connected to boom assembly 26 front end portion 32. Although a material dislodging head such as dislodging head 34 is illustrated in the Figures, it should be understood that any desired dislodging head 34 known in the art may be secured to boom assembly 26 front end portion 32. It should be further understood that dislodging head 34 and boom assembly 26 are illustrated schematically in the Figures, and any boom assembly pivotally secured to the front end 30 of frame assembly 16 capable of being selectively raised and lowered to move dislodging head 34 vertically across mine face 14 to dislodge material may be used without departing from this invention.

Mining machine 10 also includes a conveyor system generally designated by the numeral 36. Conveyor system 36 extends longitudinally from the front end 30 of frame assembly 16 to a location rearwardly of the rear end 24 of frame assembly 16. Conveyor system 36 includes a conveyor first section 38 which extends longitudinally through the center of frame assembly 16. Conveyor system 36 also includes a conveyor second section 40 which extends rearwardly of the rear end 24 of frame assembly 16 and is pivotally connected to conveyor first section 38 for lateral movement relative to conveyor first section 38. In this manner, conveyor second section 40 can be suitably positioned to deposit material provided to conveyor system 36 by dislodging head 34 at a preselected location rearwardly of the rear end of mining machine 10. Although not specifically illustrated in the Figures, conveyor second section 40 may be inclined relative to conveyor first section 38 if it is desired to deposit the dislodged material into a receiver.

Conveyor first and second sections 38, 40 include a common conveyor deck 42. A plurality of spaced flights 44 connected to an endless chain 46 transport material dislodged by dislodging head 34 rearwardly of the rear end of mining machine 10 along the common conveyor deck 42 of conveyor first and second sections 38, 40.

Mining machine 10 further includes a pair of material gathering assemblies 48 positioned on mining machine 10 gathering head 49 laterally of conveyor first section 38. Both the material gathering assemblies 48 and gathering head 49 are known in the art, and are illustrated schematically in FIG. 1. Each material gathering assembly 48 includes a plurality of arms 50 which are rotated to collect material dislodged by dislodging head 34 and direct the dislodged material along gathering head 49 onto longitudinal conveyor system 36.

As seen in FIGS. 1 and 2, continuous mining machine 10 also includes a roof support assembly generally designated by the numeral 52 which is operable in a free-standing position to provide roof support while mining machine 10 continues to advance into mine face 14 and dislodge material therefrom.

The roof support assembly generally designated by the numeral 52 includes a pair of individual support assemblies 56 positioned outwardly from the sides 58 of frame assembly 16 and connected by means of a beam 60 positioned transversely of the mining machine 10 longitudinal axis.

As seen in FIG. 1, tranverse beam 60 has length which exceeds the width of frame assembly 16 and is supported by a pair of longitudinal support members 62 positioned on each side of longitudinal conveyor 36. Each longitudinal support member 62 has a top surface portion 64, and transverse beam 60 is capable of being positioned at a preselected location on the support members 62 top surface portions 64 by an advancer unit generally designated by the numeral 65. As will be explained later in greater detail, advancer unit 65 is operable to slide transverse beam 60 along the top surfaces 64 of longitudinal support members 62 to move the pair of individual support assemblies 56 between the positions illustrated in phantom in FIG. 1. As will also be explained later in greater detail, roof support assembly 52 is lifted vertically off the pair of support members 62 to a free-standing position when it is desired to install roof supports above mining machine 10. Since roof support assembly 52 is capable of assuming a free-standing position while installing roof supports, mining machine 10 can continue its advancement into mine face 14 to dislodge material therefrom as roof supports are being installed.

Referring to FIG. 1, the advancer unit generally designated by the numeral 65 includes a pair of cylinder assemblies 66 positioned inwardly of the pair of longitudinal support members 62. Although the pair of cylinder assemblies 66 are positioned as shown in FIG. 1, it should be understood that they may be positioned outwardly from the pair of longitudinal support members if desired. Each cylinder assembly 66 has a body portion 68 connected by suitable means to the inside walls 71 of the longitudinal support members 62. Each cylinder assembly 66 also includes an extensible rod 70 with a rod end portion 72 connected by suitable means to advancer beam 73.

Advancer beam 73 is fastened for sliding movement in a longitudinal direction on the top surfaces 64 of longitudinal support members 62. As seen in FIG. 1, since the extensible rods 70 of the pair of cylinder assemblies 66 are connected with advancer beam 73, longitudinal movement of advancer beam 73 is accomplished by either extending or retracting the pair of rods 70.

Advancer beam 73 also includes a latch assembly generally designated by the numeral 75. Latch assembly 75 is adapted to engage a receiver assembly generally designated by the numeral 77 mounted on transverse beam 60. Both latch assembly 75 on advancer beam 73 and receiver assembly 77 on transverse beam 60 are illustrated schematically in FIG. 1 and it should be understood that any suitable latch and receiver may be used without departing from this invention.

In order to position roof support assembly 52 at a desired location on longitudinal support members 62, the pair of cylinder assemblies 66 are actuated to extend the pair of rods 70 and move advancer beam 73 longitudinally on support members 62 until latch assembly 75 engages receiver assembly 77 on transverse beam 60. Receiver assembly 77 captures latch assembly 75 to permit transverse beam 60 to be positioned at a desired location on the pair of longitudinal support members 62 by operation of cylinder assemblies 66. As seen in FIG. 1, retracting the pair of rods 70 into their respective cylinder bodies 68 will move transverse beam 60 longitudinally in a direction towards the rear end 24 of frame assembly 16. Conversely, extending rods 66 will move transverse beam 60 longitudinally in a direction towards the front end 30 of frame assembly 16. As described, advancer unit 73 is operable to position roof support assembly 52 at a desired location on frame assembly 16. After roof support assembly 52 is suitably positioned, latch assembly 75 is disengaged from receiver assembly 77 to disengage advancer unit 65 from roof support assembly 52. As will be explained later in greater detail, advancer unit 65 is disengaged from roof support assembly 52 to allow roof support assembly 52 to assume a free-standing position and provide roof support above mining machine 10 as mining machine 10 advances into mine face 14.

Referring to FIGS. 1 and 2, each individual support assembly 56 includes a pair of hydraulically actuated jack assemblies 74 each having a pair of extensible rods (not shown in FIGS. 1 and 2) which are operable upon actuation of the jack assemblies to extend between mine roof 54 and mine floor 20 to provide temporary support to mine roof 54. Each jack assembly 74 has a top pad 76 connected with the upwardly extending rod positioned in the jack housing to abut the surface of mine roof 54 upon actuation of the upwardly extending rod. The downwardly extending rods in the pair of jack assemblies 74 are connected at their ends by a plate 78. The downwardly extending rods are connected to plate 78 with a conventional pivoting-type ball and socket arrangement to allow plate 78 to fully contact mine floor 20 when roof support assembly 52 is operated in a mine having a sloped or uneven floor. The operation of the individual components in each of the jack assemblies will be explained in greater detail when discussing FIG. 3.

Positioned between the pair of hydraulically actuated jack assemblies 74 is a roof bolting apparatus generally designated by the numeral 80. Although the specific connection of roof bolting apparatus 80 to assembly 56 is not illustrated in FIGS. 1 and 2, roof bolting apparatus 80 is itself known in the art. Roof bolting apparatus 80 may be raised or lowered by any suitable means to allow roof bolting apparatus 80 to drill a hole in mine roof 54 and thereafter anchor a roof bolt in the drilled hole.

As seen in FIG. 1, each assembly 56 also includes a crossbeam lift cylinder assembly 82 positioned between roof bolting apparatus 80 and the sides 58 of frame assembly 16. Crossbeam lift cylinder assembly 82 has an extensible rod (not shown in FIGS. 1 and 2) operable upon actuation of crossbeam lift cylinder assembly 82 to extend upwardly in a direction towards mine roof 54. Connected to the end of the extensible rod is a crossbeam support pad 84.

Although not specifically illustrated in FIGS. 1 and 2, the pair of crossbeam lift cylinder assemblies 82 on the pair of individual support assemblies 56 are located to provide that portions of a crossbeam positioned on the pair of crossbeam support pads 84 lie directly above the roof bolting apparatus 80 on each individual support assembly 56. In this manner, after the crossbeam lift cylinder assemblies 82 are actuated to raise a crossbeam positioned on the pair of support pads 84 into abutting contact with mine roof 54, the roof bolting apparatus 80 on each individual assembly 56 may be raised to drill a pair of holes through the crossbeam and into mine roof 54. After the drilling phase is completed, a roof bolt is inserted in each roof bolting apparatus and the pair of roof bolting apparatus 80 are raised to pass portions of the roof bolts through the holes in the crossbeam and into the holes drilled in the mine roof. The roof bolts are anchored in the mine roof and maintain the crossbeam in abutting contact with the mine roof to provide permanent roof support. As previously described, since roof support assembly 52 is capable of independent longitudinal movement on frame assembly 16 and capable of assuming a free-standing position, the plurality of jack assemblies 74 may be actuated to provide temporary roof support and a crossbeam may be anchored to mine roof 54 while mining machine 10 continuously advances to dislodge material from mine face 14.

Figure 3:
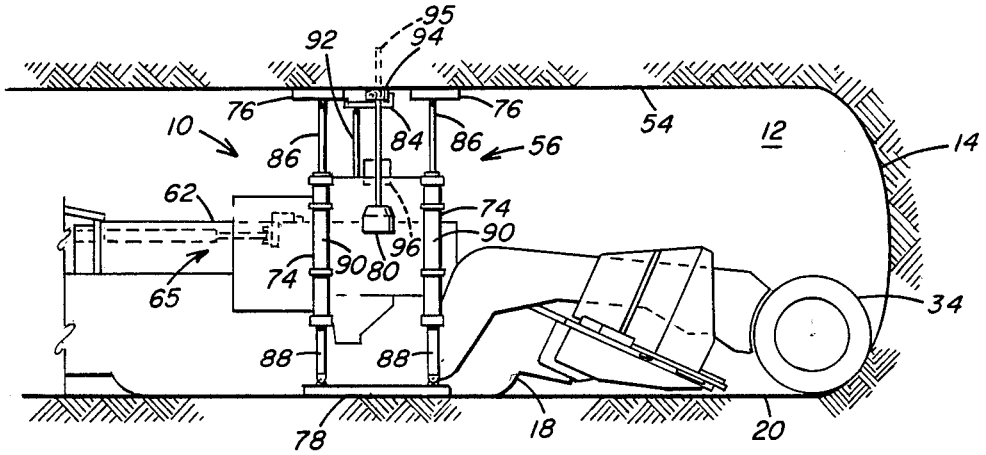
FIG. 3 is a side elevational view of a portion of the continuous mining machine of FIG. 1, illustrating one of a pair of roof support assemblies during operation to secure a crossbeam to a roof of the mine.

Referring to FIG. 3, there is illustrated a portion of mining machine 10 advancing along a mine floor 20 to bring dislodging head 34 into contact with mine face 14 to remove material therefrom. Roof support assembly 52 has been positioned at a desired location on support members 62 by advancer unit 65 and advancer unit 65 has been disengaged from transverse beam 60. Although only one individual support assembly 56 of roof support assembly 52 is illustrated in FIG. 3, it should be understood that the pair of individual support assemblies 56 secured to the ends of transverse beam 60 are operated together in order to permanently support mine roof 54 as mining machine 10 continues to dislodge material from mine face 14.

As seen in FIG. 3, the pair of jack assemblies 74 on support assembly 56 have been actuated to first extend the lower rods 88 from their respective jack bodies 90 to bring base plate 78 connected with lower rods 88 into abutting contact with mine floor 20. After base plate 78 is brought into contact with mine floor 20, continued extension of lower rods 88 from their respective jack bodies 90 raises transverse beam 60 vertically off of the longitudinal support members 62 to bring roof support assembly 52 to a free-standing position separated from mining machine 10. With roof support assembly 52 in a free-standing position, mining machine 10 is free to advance into mine face 14 independently of roof support assembly 52.

After lower rods 88 are extended to bring base plate 78 into contact with mine floor 20 and raise roof support assembly 52 to a free-standing position, upper rods 86 are extended from their respective jack bodies 90 to bring the pair of top pads 76 connected with upper rods 86 into abutting contact with mine roof 54. With upper and lower rods 86, 88 in an extended position, the pair of pads 76 and base plate 78 provide temporary roof support above mining machine 10 as roof support assembly 52 is further operated to provide permanent roof support.

Also shown in FIG. 3 is the extensible rod 92 of crossbeam lift cylinder assembly 82 raised vertically to bring a crossbeam 94 positioned on support pad 84 into abutting contact with mine roof 54. Roof bolting apparatus 80 is provided with a drill bit 96 and advanced upwardly to drill a hole through crossbeam 94 and a hole 95 a preselected distance into mine roof 54. After roof bolting apparatus 80 has drilled a hole completely through crossbeam 94 and hole 95 a preselected distance into mine roof 54, roof bolting apparatus 80 is lowered. Drill bit 96 is replaced with a roof bolt (not shown), and thereafter roof bolting apparatus 80 is raised to pass a portion of the roof bolt through the hole drilled in crossbeam 94 into the hole 95 in mine roof 54. The pair of roof bolts passed through the pair of holes in crossbeam 94 and into holes 95 by operation of roof bolting apparatus 80 are anchored in the holes 95 by any suitable method known in the art to maintain crossbeam 94 in abutting contact with mine roof 54.

After crossbeam 94 is anchored to mine roof 54 by the pair of roof bolts, the extensible rods 92 of the pair of crossbeam lift cylinder assemblies 82 are lowered, and the upper and lower rods 86, 88 of jack assemblies 74 are retracted to lower transverse beam 60 onto the pair of longitudinal supports 62.

As described, crossbeam lift cylinder assemblies 82, jack assemblies 74 and roof bolting apparatus 80 on the pair of individual support assemblies 56 are operable to secure a crossbeam to mine roof 54 and provide permanent mine roof support while mining machine 10 is continuously operated to dislodge material from mine face 14.

Figure 4:
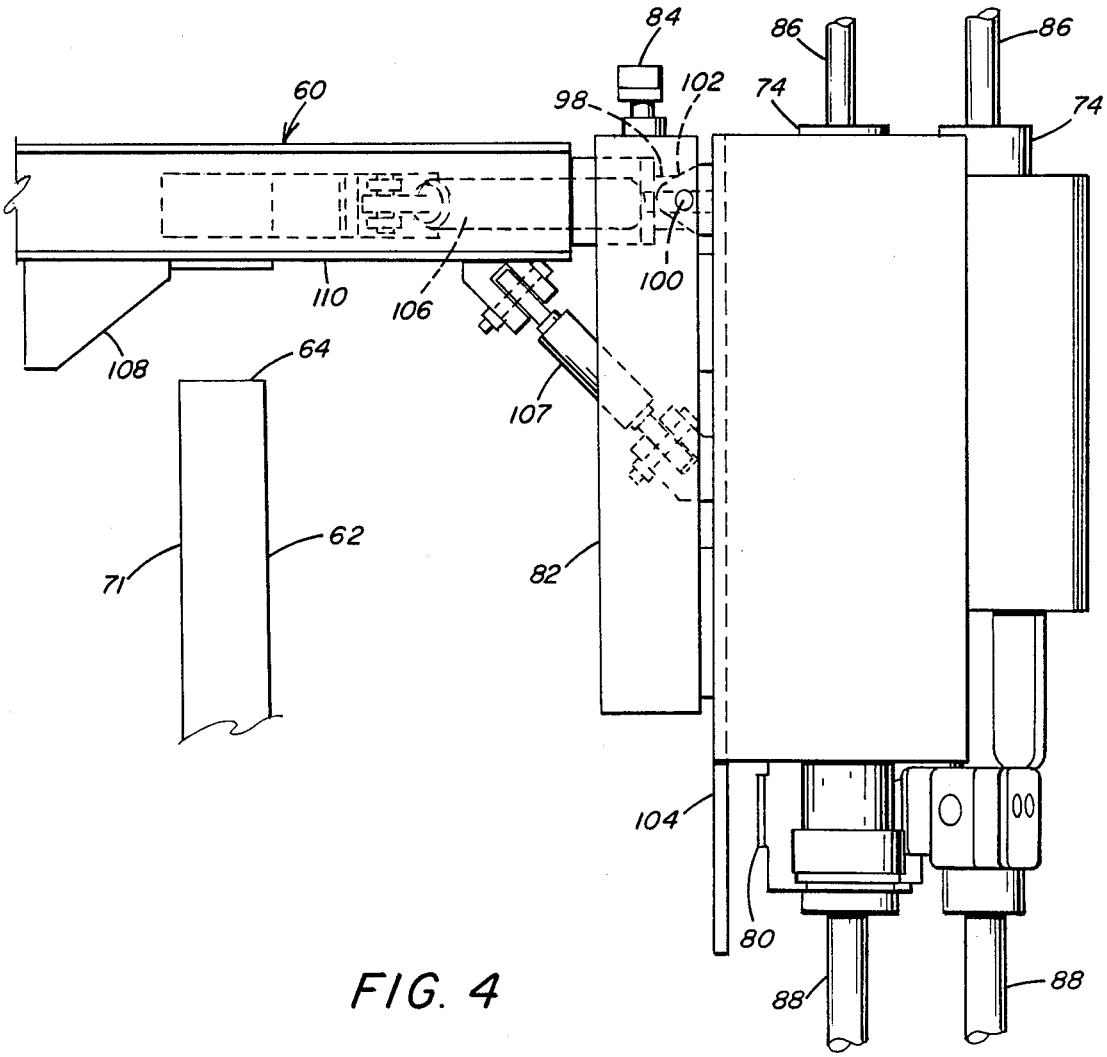
FIG. 4 is a view taken along line IV—IV of FIG. 1, illustrating the connection between a roof support assembly and a portion of a beam member positioned on the mining machine transversely of the longitudinal axis of the mining machine.
Figure 5:
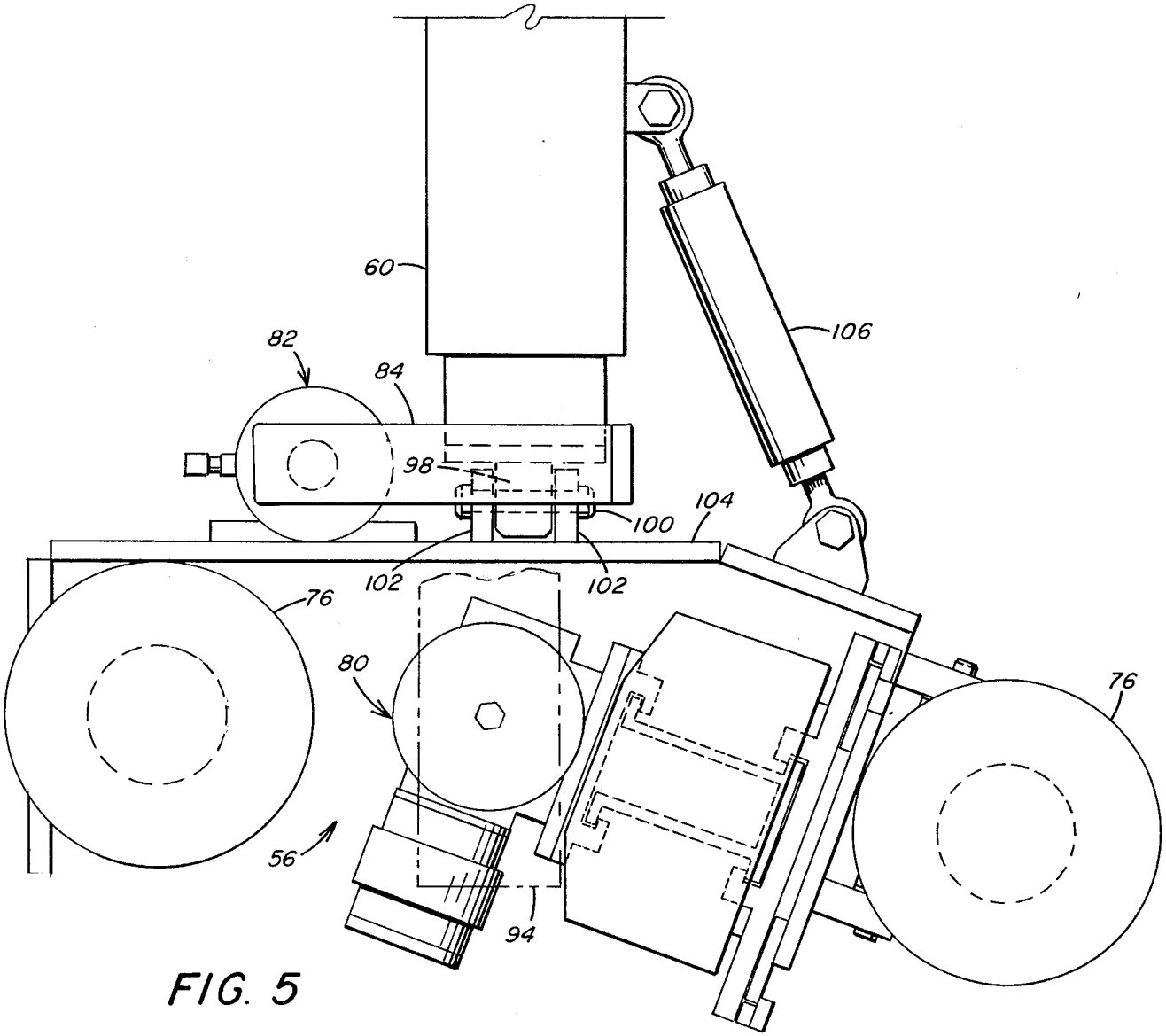
FIG. 5 is a top plan view of the roof support assembly and a portion of the transverse beam of FIG. 4.

Referring to FIGS. 4 and 5, there are illustrated detailed views of the connection between an individual support assembly 56 and transverse beam 60. Although FIGS. 4 and 5 illustrate the connection between a single support assembly 56 and transverse beam 60, it should be understood that both support assemblies 56 are connected to transverse beam 60 in an identical manner.

As seen in FIGS. 4 and 5, transverse beam 60 has an end portion 98 having a bore therethrough for receiving a pin member 100. The end portion 98 of transverse beam 60 extends between a pair of connecting lugs 102 which are bored to also receive pin member 100. End portion 98 is inserted between the pair of connecting lugs 102 and pin member 100 is passed through the openings in the pair of lugs 102 and the opening in end portion 98 to secure end portion 98 to a plate 104 which forms a part of assembly 56. A pair of members 106, 107 are also connected between transverse beam 60 and plate 104. Members 106 and 107 are standard shock absorbing members known in the art and are operable to absorb the vibrating forces generated as roof bolting apparatus 80 is operated.

There is further illustrated in FIG. 4 a portion of a longitudinal support member 62 having a top surface portion 64. As seen in FIG. 4, the upper and lower rods 86, 88 of jack assemblies 74 are extended to raise transverse beam 60 vertically off longitudinal support member 62 top surface 64. In order to properly center transverse beam 60 after the upper and lower rods 86, 88 are retracted and transverse beam 60 is lowered onto top surface 64, a pair of downwardly extending guides 108 (one shown) are secured to the bottom wall 110 of transverse beam 60. Although only one guide 108 is illustrated in FIG. 4, it should be understood that the pair of downwardly extending guides 108 are secured to the bottom wall 110 of transverse beam 60 and positioned between the pair of longitudinal support members 62 inside walls 71 to properly center transverse beam 60 on the pair of longitudinal support members 62.

As described, roof support assembly 52 is movable in a longitudinal direction on the pair of support members 62 independently of the movement of continuous mining machine 10. In addition, roof support assembly 52 is capable of being raised vertically from mining machine 10 to a free-standing position to install roof supports in the mine roof above mining machine 10 while mining machine 10 is advanced within a mine to dislodge material from the mine face. Since roof support assembly 52 is free to remain in a free-standing position disengaged from mining machine 10 while installing permanent roof supports, mining machine 10 is capable of uninterrupted advancement through the mine as a crossbeam is anchored to the mine roof.

In addition to providing a roof support assembly 52 capable of remaining in a free-standing position disengaged from mining machine 10 while installing permanent roof supports in mine roof 54, the preferred mining machine 10 also includes means for deflecting loose material adjacent the mine ribs onto the gathering head 49 of mining machine 10 and onto longitudinal conveyor system 36.

Referring to FIG. 1, the preferred mining machine 10 includes a gathering head schematically illustrated and designated by the numeral 49. A pair of gathering head extensions generally designated by the numerals 112 are movably secured to gathering head 49 and are operable in an extended position as shown in FIG. 1 to contact mine ribs 114 and gather loose material from mine floor 20. Loose material gathered by the pair of extensions 112 is deflected onto gathering head 49. Thereafter, the loose material is passed onto longitudinal conveyor 36 and transported rearwardly of mining machine 10. As will be explained later in greater detail, the pair of gathering head extensions 112 may be moved to a retracted position on gathering head 49 when not in use.

As seen in FIG. 1, the gathering head extensions generally designated by the numerals 112 are mounted on gathering head 49 rearwardly of dislodging head 34. The gathering head extensions 112 are positioned outwardly from the pair of material gathering assemblies 48, and loose material collected by each gathering head extension 112 is deflected towards an adjacent material gathering assembly 48. As loose material is received by the pair of gathering head assemblies 48, the rotating gathering arms 50 of each assembly move the loose material onto conveyor deck 42 of longitudinal conveyor 36. The loose material is transported rearwardly of the rear end 24 of mining machine 10 by the plurality of spaced flights 44.

Figure 6:
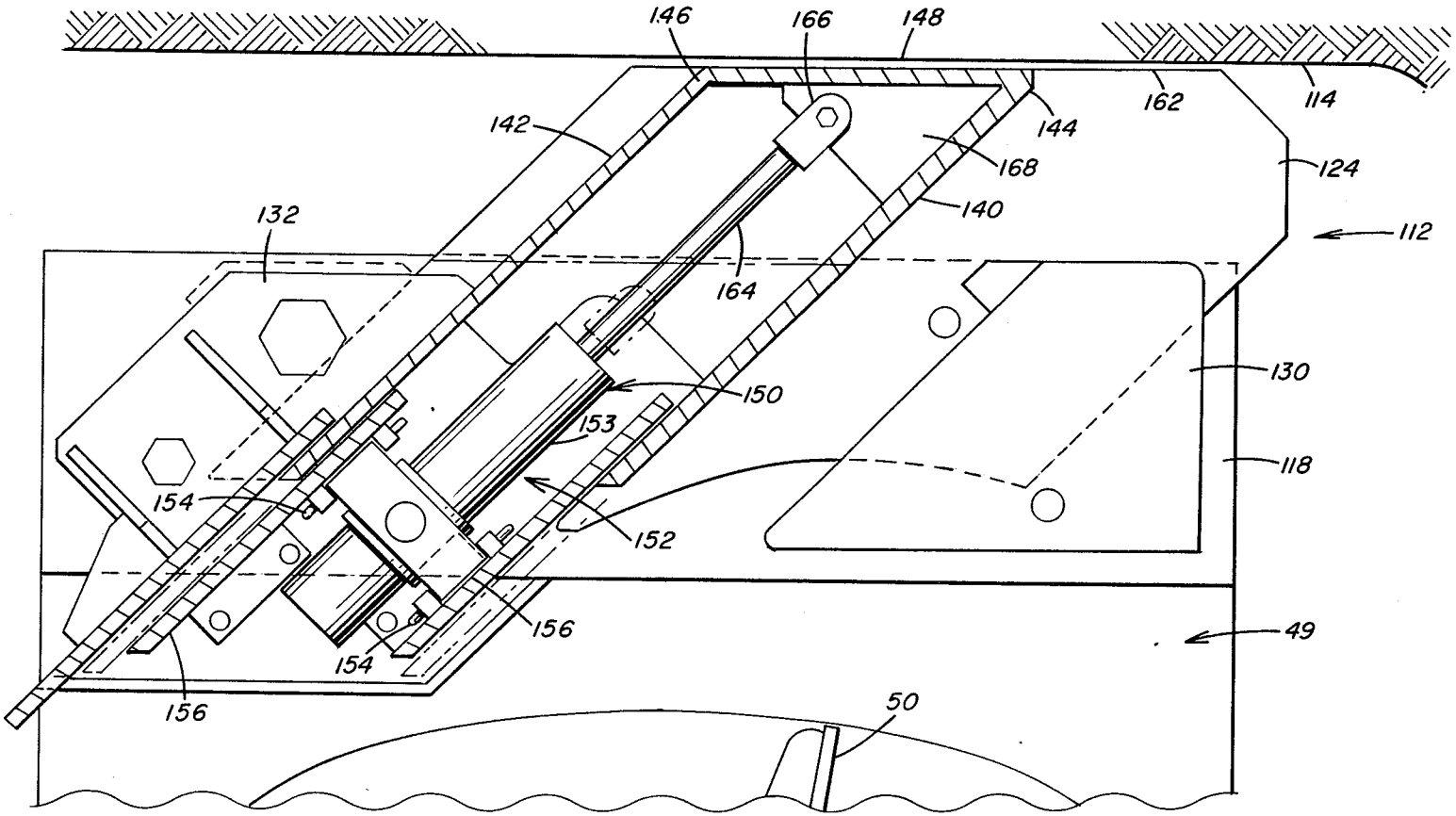
FIG. 6 is a partial fragmentary top plan view of a gathering head extension mounted on a mining machine gathering head.
Figure 7:
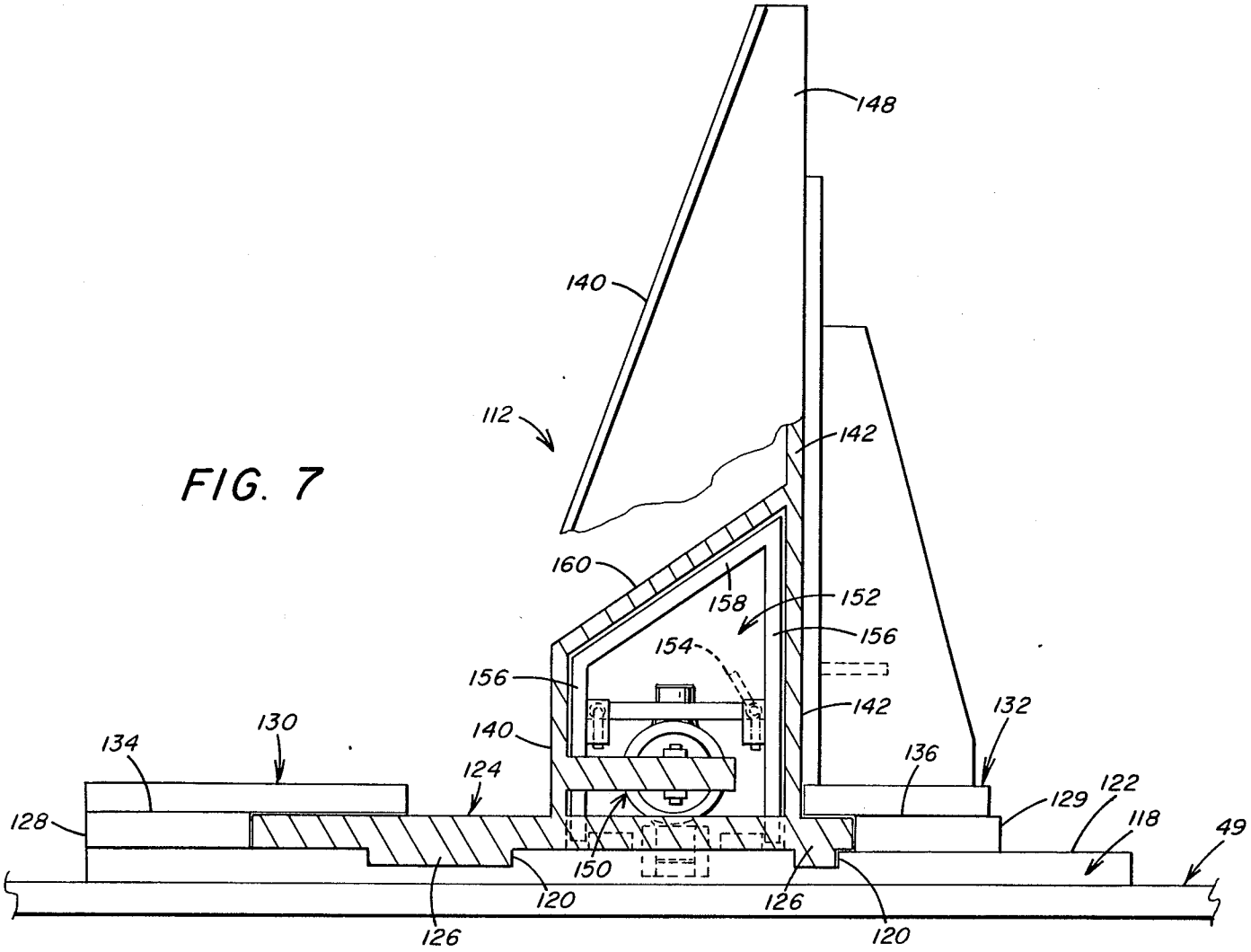
FIG. 7 is a partial sectional view taken along line VII—VII of FIG. 1.

An individual gathering head extension 112 is further illustrated in FIGS. 6 and 7. As seen in FIGS. 6 and 7, each gathering head extension 112 includes base plate 118 secured by suitable means to gathering head 49. Base plate 118 has a pair of upwardly opening linear guide slots 120 which are parallel with each other and angularly spaced from a longitudinal axis of gathering head 49. Positioned above base plate 118 is a plate member 124 having a pair of downwardly extending guide bars 126 arranged to be received in the pair of linear guide slots 120 in base plate 118. As seen, plate member 124 is movable along a linear path of travel on base plate 118 due to the engagement of guide bars 126 in the upwardly opening linear guide slots 120.

A pair of spacer members 128, 129 are positioned on the top surface 122 of base plate 118, and retainers 130 and 132 are positioned on the top surfaces 134, 136 of spacer members 128, 129 respectively. The retainers 130, 132, and spacers 128, 129 may be secured to base plate 118 by any suitable means, such as by bolting or welding. In addition, base plate 118 may be secured to gathering head 49 by similar suitable means.

As seen in FIGS. 6 and 7, the pair of retainers 130, 132 are each in overlying relation with a portion of plate member 124 to maintain the pair of plate member guide bars 126 within the upwardly opening linear guide slots 120 of base plate 118.

Extending upwardly from plate member 124 are a pair of walls 140, 142 which form a deflector housing for channeling loose material from the adjacent mine rib 114 onto gathering head 49. The pair of walls 140, 142 are connected at their end portions 144, 146 respectively by a plate 148. A hydraulically actuated cylinder 150 is positioned within the hollow interior 152 formed by walls 140, 142, and plate 148. Hydraulic cylinder 150 has a body portion 153 which is removably connected by a pair of pin members 154 to a pair of upwardly extending inner guide walls 156 connected at their respective bases to base plate 118. The pair of inner guide walls 156 are connected at their top portions by a plate member 158 to form a housing which encases hydraulic cylinder 150. As further illustrated in FIG. 7, the walls 140 and 142 are connected within hollow interior 152 by a plate member 160 positioned substantially parallel to plate member 158. The pair of inner guide walls 156 are positioned to stabilize the pair of walls 140, 142 as gathering head extension 112 is moved into contact with an adjacent mine rib 114 as illustrated in FIG. 1.

Movement of gathering head extension 112 on gathering head 49 to bring the lateral edge surface 162 of plate member 124 into abutting contact with an adjacent mine rib 114 is accomplished by actuation of hydraulic cylinder 150. As seen in FIGS. 6 and 7, hydraulic cylinder 150 has an extensible rod portion 164 with a rod end portion 166 connected to plate 168, and plate 168 is connected between wall 140 and plate 148. As rod portion 164 is extended outwardly from cylinder body portion 153, the lateral edge surface 162 of plate member 124 is brought into contact with an adjacent mine rib 114. Suitable controls (not shown) are provided to maintain rod portion 164 in an extended position to maintain the lateral edge surface 162 of plate member 124 in abutting contact with the adjacent mine rib 114. With the pair of gathering head extensions 112 in an extended position as illustrated in FIG. 1, it is seen that the lateral edge surface 162 of each extension 112 extends laterally past the ends 170 of dislodging head 34. This allows the lateral edge surfaces 162 to maintain contact with mine ribs 114 if mining machine 10 skews to one side while dislodging material from mine face 14.

As described, as mining machine 10 is moved to dislodge material from mine face 14, loose material on mine floor 20 is passed across the top surface of plate member 124 and deflected by wall 140 onto gathering head 49 towards the rotating gathering arms 50 of material gathering assembly 48. In this manner, loose material on mine floor 20 adjacent the mine ribs 114 is collected and passed onto longitudinal conveyor 36.

According to the provisions of the Patent Statutes, we have explained the principle, preferred construction and mode of operation of our invention and have illustrated and described what we now consider to represent its best embodiments. However, it is should be understood that, within the scope of the appended claims, the invention may be practiced otherwise than as specifically illustrated and described.

I claim:

1. A roof bolting device arranged in operable relation with a mining machine comprising, a pair of roof bolting means arranged to be positioned outwardly from the sides of a mining machine and operable to install roof bolts in a mine roof above said mining machine, connecting means positioned substantially transversely of a longitudinal axis of said mining machine for connecting said roof bolting means, means for selectively moving said roof bolting means in a longitudinal direction relative to said mining machine independently of the longitudinal movement of said mining machine to install said roof bolts at preselected locations in said mine roof above said mining machine, and latch means to selectively engage and disengage said connecting means to said means for selectively moving said roof bolting means whereby said roof bolting means is released from said mining machine when said latch means is disengaged.

2. A roof bolting device arranged in operable relation with a mining machine as set forth in claim 1 in which, said connecting means is formed from a beam member having a pair of end portions extending outwardly from the sides of said mining machine, and one of said roof bolting means is connected to a beam member end portion.

3. A roof bolting device arranged in operable relation with a mining machine as set forth in claim 1 which includes, temporary roof support means operable to move said connecting means and said roof bolting means to a free-standing position separated from said mining machine, said temporary roof support means providing temporary roof support above said mining machine and allowing said roof bolting means to install roof bolts at preselected locations in said mine roof as said mining machine continuously advances.

4. A continuous mining machine comprising, a frame assembly having a front end portion and a rear end portion, dislodging means mounted to said frame assembly front end portion, propelling means for propelling said frame assembly within a mine along a floor of said mine to advance said dislodging means into a face of said mine to dislodge material therefrom, conveyor means mounted on said frame assembly for receiving said dislodged material from said dislodging means, a pair of assemblies arranged to be positioned outwardly from the sides of said frame assembly, each said assembly including roof bolting means for installing roof bolts in a mine roof above said frame assembly and roof support means operable to engage said roof and said floor to provide temporary roof support during operation of said roof bolting means, transverse connecting means having a pair of end portions extending outwardly from the sides of said frame assembly, one of said assemblies connected with one of said transverse connecting means end portions, advancing means connected with said frame assembly and operable to selectively engage said transverse connecting means to position said transverse connecting means at a preselected location relative to said frame assembly, and latch means to selectively engage and disengage said advancing means to said transverse connecting means for selectively moving said transverse connecting means relative to said frame assembly whereby said transverse connecting means is released from said frame assembly when said latch means is disengaged.

5. A continuous mining machine as set forth in claim 4 in which, said frame assembly has a longitudinal support means positioned thereon, said transverse connecting means rests for longitudinal movement on said longitudinal support means, and said transverse connecting means is lifted vertically from said longitudinal support means by said roof support means to place said transverse connecting means and said pair of assemblies in a free-standing position separated from said frame assembly.

6. A continuous mining machine as set forth in claim 5 in which, said conveyor means includes a longitudinal conveyor section mounted on said frame assembly and extending rearwardly from said dislodging means, said longitudinal support means includes a pair of longitudinal support members positioned on each side of longitudinal conveyor section, each said longitudinal support member having a generally flat top surface portion, and said transverse connecting means is positioned for sliding movement on said longitudinal support means top surface portions by said advancing means.

7. A continuous mining machine with roof bolter attachment as set forth in claim 5 in which said transverse connecting means includes, guide means extending downwardly from a bottom surface portion of said transverse connecting means for centering said transverse connecting means between said longitudinal support members.

8. A continuous mining machine as set forth in claim 4 which includes, crossbeam lift means on each said assembly for supporting a crossbeam positioned above and transversely of said frame assembly, said crossbeam lift means operable to raise said crossbeam vertically into abutting contact with said mine roof, and said roof bolting means installing roof bolts in said mine roof through holes in said crossbeam to maintain said crossbeam in abutting relation with said mine roof.

9. A continuous mining machine as set forth in claim 8 in which, said crossbeam lift means, said roof bolting means and said support means are operable to position said crossbeam in abutting relation with said mine roof and anchor said crossbeam to said mine roof while said frame assembly is being propelled within said mine to dislodge said material from said mine face.

10. A continuous mining machine as set forth in claim 4 in which said roof support means includes, a plurality of hydraulically actuated means, each said hydraulically actuated means having extensible rod means therein, said extensible rods means operable to extend into abutting engagement with said mine roof and said mine floor to temporarily support said mine roof during operation of said roof bolting means.

11. A continuous mining machine as set forth in claim 4 in which, said roof bolting means is adapted to receive drill means for drilling said holes in said crossbeam with said crossbeam in abutting relation with said mine roof, and said roof bolting means drilling holes through said crossbeam and into said mine roof to receive said roof bolts.

12. A method for anchoring crossbeam supports to a mine roof while dislodging material from a mine face comprising the steps of, placing a crossbeam on a pair of crossbeam lift means positioned on each side of a mining machine so that portions of said crossbeam lie directly above a pair of roof bolting means positioned on each side of said mining machine, disengaging said lift means from said mining machine after positioning said lift means relative to said mining machine, providing a pair of roof support means with hydraulically actuated means operable to extend between said mine floor and said mine roof to provide temporary support while said crossbeam is being anchored to said mine roof, extending said pair of roof support means positioned on each side of said mining machine into contact with said mine roof and a floor of said mine to provide said temporary support to said mine roof, lifting said crossbeam into abutting relation with a roof of said mine with said pair of crossbeam lift means, connecting said crossbeam lift means, said roof support means and said roof bolting means positioned on each side of said mining machine by a transverse connecting means, positioning said transverse connecting means for sliding movement on a second support means extending longitudinally on said mining machine, extending said hydraulically actuated means on said pair of roof support means into contact with said mine floor to raise said transverse connecting means to a free-standing position separated from said mining machine to allow said crossbeam to be anchored to said mine floor as said mining machine is propelled along said mine floor, inserting drill means in each said roof bolting means and raising said pair of roof bolting means to drill a pair of holes through said crossbeam and into said mine roof, lowering said pair of roof bolting means and inserting roof bolts in each of said pair of roof bolting means, raising said pair of roof bolting means to pass a roof bolt through each of said holes drilled in said crossbeam and into said holes in said mine roof to anchor said crossbeam to said mine roof, and propelling said mining machine along said mine floor to advance a dislodging means connected with said mining machine into a face of said mine to dislodge material therefrom as said crossbeam is being anchored to said mine roof.

13. A continuous mining machine for dislodging material from a mine face comprising, a frame assembly having a front end portion and a rear end portion, dislodging means mounted on said frame assembly front end portion, propelling means for propelling said frame assembly along a floor of a mine to advance said dislodging means into a face of said mine to dislodge material therefrom, conveyor means mounted on said frame assembly for receiving said dislodged material from said dislodging means, gathering head means connected with said frame assembly front end portion and extending forwardly of said frame assembly front end portion to a location rearwardly of said dislodging means, and a pair of gathering head extension means, each said gathering head extension means positioned laterally on said gathering head means rearwardly of said dislodging means, each said gathering head extension means angularly spaced from a longitudinal axis of said gathering head means and movable in a linear path from a retracted position to an extended position to engage an adjacent rib of said mine and deflect dislodged material from said mine floor onto said gathering head means, each said gathering head extension means including (i) a base secured to a top surface portion of said gathering head means rearwardly of said dislodging means, said base plate having a plurality of upwardly opening linear guide slots, said plurality of guide slots in parallel relation with each other and angularly spaced from said longitudinal axis of said gathering head means, (ii) a plate member having a plurality of downwardly extending linear guide bars arranged to be received in said plurality of base plate linear guide slots to maintain said plate member movable along a linear path of travel on said base plate, (iii) retaining means for movably securing said plate member on said base plate, (iv) a front wall and a rear wall spaced from each other and extending upwardly from a top surface portion of said plate member to form a hollow interior portion, (v) a side wall extending between said front wall and said rear wall to connect said front wall with said rear wall, and (vi) hydraulically actuated means positioned within said hollow interior portion, said hydraulically actuated means connected between said base plate and said side wall said hydraulically actuated means being operable to move said plate member in said linear path on said base plate to bring a lateral edge portion of said plate member into engagement with an adjacent mine rib to deflect dislodged material onto said plate member and along said front wall.

14. A continuous mining machine for dislodging material from a mine face as set forth in claim 13 which includes, a pair of spaced apart guide walls extending upwardly from said base plate and positioned inwardly of said front wall and said rear wall to maintain said plate member movable along said linear path of travel on said base plate.

15. A continuous mining machine for dislodging material from a mine face as set forth in claim 13 in which, said plate member lateral edge portion is moved to a position outwardly from a lateral edge portion of said gathering head means as said gathering head extension means is moved from said retracted position to said extended position.

16. A continuous mining machine for dislodging material from a mine face as set forth in claim 13 in which, said hydraulically actuated means maintains said plate member lateral edge portion in substantially constant pressure engagement with said adjacent mine rib with said gathering head extension means in said extended position.

17. A continuous mining machine for dislodging material from a mine face comprising, a frame assembly having a front end portion and a rear end portion, dislodging means mounted to said frame assembly front end portion, gathering head means connected with said frame assembly front end portion and extending forwardly of said frame assembly front end portion to a location rearwardly of said dislodging means, propelling means for propelling said frame assembly within a mine along a floor of said mine to advance said dislodging means into a face of said mine to dislodge material therefrom, conveyor means mounted on said frame assembly to receive said dislodged material from said dislodging means, longitudinal support means positioned on said frame assembly, transverse connecting means movably positioned on said longitudinal support means, said transverse connecting means having a pair of end portions extending outwardly from the sides of said frame assembly, an assembly secured to each said transverse connecting means end portion, each said assembly including roof bolting means for installing roof bolts in a roof of said mine above said frame assembly and roof support means operable to engage said mine floor and said mine roof to provide temporary roof support as said roof bolting means is operated, advancer means positioned on said longitudinal support means operable to engage said transverse connecting means and move said transverse connecting means to a preselected position on said longitudinal support means, latch means to selectively engage and disengage said advancer means to said transverse connecting means for selectively moving said transverse connecting means relative to said frame assembly whereby said transverse connecting means is released from said frame assembly when said latch means is disengaged, and a pair of gathering head extension means, each said gathering head extension means positioned laterally on said gathering head means rearwardly of said dislodging means, each said gathering head extension means angularly spaced from a longitudinal axis of said gathering head means and movable in a linear path from a retracted position to an extended position to engage an adjacent rib of said mine and deflect dislodged material from said mine floor onto said gathering head means.

18. A continuous mining machine comprising, a frame assembly having a front end portion and a rear end portion, dislodging means mounted to said frame assembly front end portion, propelling means for propelling said frame assembly within a mine along a floor of said mine to advance said dislodging means into a face of said mine to dislodge material therefrom, conveyor means mounted on said frame assembly for receiving said dislodged material from said dislodging means, a pair of assemblies arranged to be positioned outwardly from the sides of said frame assembly, each said assembly including roof bolting means for installing roof bolts in a mine roof above said frame assembly and roof support means operable to engage said roof and said floor to provide temporary roof support during operation of said roof bolting means, transverse connecting means having a pair of end portions extending outwardly from the sides of said frame assembly, one of said assemblies connected with one of said transverse connecting means end portions, said frame assembly having a longitudinal support means positioned thereon, said transverse connecting means resting for longitudinal movement on said longitudinal support means, said transverse connecting means being lifted vertically from said longitudinal support means by said roof support means to place said transverse connecting means and said pair of assemblies in a free-standing position separated from said frame assembly, advancing means movably connected with said frame assembly and operable to engage said transverse connecting means to position said transverse connecting means at a preselected location relative to said frame assembly, said advancing means including an advancer beam slidably connected with said longitudinal support means and position between said transverse connecting means and said frame assembly rear end portion, hydraulically actuated means connected between said advancer beam and said frame assembly operable to move said advancer beam in a preselected longitudinal direction on said longitudinal support means, and latch means connected with said advancer beam operable to engage a receiver means on said transverse connecting means to longitudinally move said transverse connecting means on said longitudinal support means as said advancer beam is longitudinally moved on said longitudinal support means.

19. A method for anchoring crossbeam supports to a mine roof while dislodging material from a mine face comprising the steps of, placing a crossbeam on a pair of crossbeam lift means positioned on each side of a mining machine so that portions of said crossbeam lie directly above a pair of roof bolting means positioned on each side of said mining machine, extending a pair of roof support means positioned on each side of said mining machine into contact with said mine roof and a floor of said mine to provide temporary support to said mine roof, providing said roof support means with hydraulically actuated means operable to extend between said mine floor and said mine roof to provide said temporary support while said crossbeam is being anchored to said mine roof, connecting said crossbeam lift means, said roof support means and said roof bolting means positioned on each side of said mining machine by a transverse connecting means, positioning said transverse connecting means for sliding movement on a support means extending longitudinally on said mining machine, positioning advancer means for sliding movement on said longitudinal support means operable to capture said transverse connecting means and move said transverse connecting means to a preselected location on said longitudinal support means, extending said hydraulically actuated means on said pair of roof support means into contact with said mine floor to raise said transverse connecting means to a free-standing position separated from said mining machine to allow said crossbeam to be anchored to said mine roof as said mining machine is propelled along said mine floor, lifting said crossbeam into abutting relation with a roof of said mine with said pair of crossbeam lift means, inserting drill means in each said roof bolting means and raising said pair of roof bolting means to drill a pair of holes through said crossbeam and into said mine roof, lowering said pair of roof bolting means and inserting roof bolts in each of said pair of roof bolting means, raising said pair of roof bolting means to pass a roof bolt through each of said holes drilled in said crossbeam and into said holes in said mine roof to anchor said crossbeam to said mine roof, and propelling said mining machine along said mine floor to advance a dislodging means connected with said mining machine into a face of said mine to dislodge material therefrom as said crossbeam is being anchored to said mine roof.

* * * * *